US006695708B2

(12) United States Patent
Fisher

(10) Patent No.: US 6,695,708 B2
(45) Date of Patent: Feb. 24, 2004

(54) GOLF PUTTER WITH POLYHEDRAL HEAD AND ROTATABLY SELECTABLE TRACTION CONTROL FACES

(76) Inventor: Dale P. Fisher, 18055 Bushard Ave., Fountain Valley, CA (US) 92708

( * ) Notice: Subject to any disclaimer, the term of this patent is extended or adjusted under 35 U.S.C. 154(b) by 0 days.

(21) Appl. No.: 09/891,858

(22) Filed: Jun. 26, 2001

(65) Prior Publication Data

US 2002/0198060 A1 Dec. 26, 2002

(51) Int. Cl.[7] ..... A63B 53/04

(52) U.S. Cl. ..... 473/244; 473/219; 473/292; 473/300; 473/340

(58) Field of Search ..... 473/329, 332, 473/342, 349, 340, 341, 244, 201, 219, 292, 300, 305, 313, 314, 315, 316, 325, 333, 335

(56) References Cited

U.S. PATENT DOCUMENTS

| | | | | | |
|---|---|---|---|---|---|
| 749,174 | A | * | 1/1904 | Davis | |
| 2,661,952 | A | * | 12/1953 | Jackson | |
| 2,708,579 | A | * | 5/1955 | Hugman | |
| 3,218,072 | A | * | 11/1965 | Burr | 473/342 |
| 3,843,122 | A | * | 10/1974 | Florian | |
| 3,975,023 | A | * | 8/1976 | Inamori | |
| 4,067,573 | A | * | 1/1978 | Key, Jr. | |
| 4,121,832 | A | * | 10/1978 | Ebbing | |
| D255,592 | S | * | 6/1980 | Krysakowski | |
| 4,422,638 | A | * | 12/1983 | Tucker | |
| 4,506,888 | A | * | 3/1985 | Nardozzi, Jr. | |
| 4,768,787 | A | * | 9/1988 | Shira | |
| 4,793,616 | A | * | 12/1988 | Fernandez | |
| 5,016,883 | A | * | 5/1991 | Kobayahi | |
| 5,154,425 | A | * | 10/1992 | Niskanen et al. | 473/342 |
| 5,415,399 | A | * | 5/1995 | Kettelson | |
| 5,489,098 | A | * | 2/1996 | Gojny et al. | 473/342 |
| 5,584,769 | A | * | 12/1996 | Sundin | |
| 5,807,190 | A | * | 9/1998 | Krumme et al. | 473/342 |
| 5,924,939 | A | * | 7/1999 | Grace et al. | 473/324 |
| 5,928,088 | A | * | 7/1999 | Matthews | |
| 5,938,543 | A | * | 8/1999 | McGeeney et al. | |
| 6,068,560 | A | * | 5/2000 | DeLuca | |
| 6,238,303 | B1 | * | 5/2001 | Fite | |
| 6,270,423 | B1 | * | 8/2001 | Webb | |
| 6,336,869 | B1 | * | 1/2002 | Hettinger et al. | 473/324 |

* cited by examiner

*Primary Examiner*—Paul T. Sewell
*Assistant Examiner*—Nini F. Legesse
(74) *Attorney, Agent, or Firm*—William L. Chapin

(57) ABSTRACT

A golf putter includes a polyhedrally-shaped head having a plurality of generally vertically disposed ball-impacting faces which have different ball impacting characteristics and a shaft having at the lower end thereof a hosel terminated by a prism-shaped lower shaft end that has a polygonal transverse cross section. The head has protruding perpendicularly downwards from an upper surface thereof a centrally located bore having a polygonal cross section of the same shape but slightly larger than that of the prism-shaped end of the hosel, which is inserted into the bore at a selected angular orientation relative to the head to position a selected ball impacting face in a conventional ball-impacting disposition relative to the shaft grip, and releasably secured at that position by a screw inserted through the sole of the head and tightened into a threaded bore provided in the hosel end.

43 Claims, 7 Drawing Sheets

Fig. 2
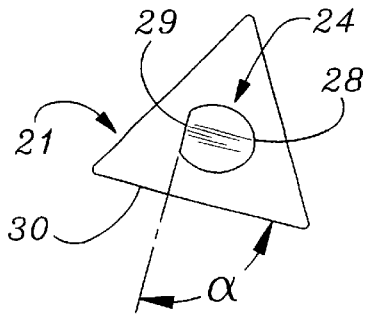
Fig. 11
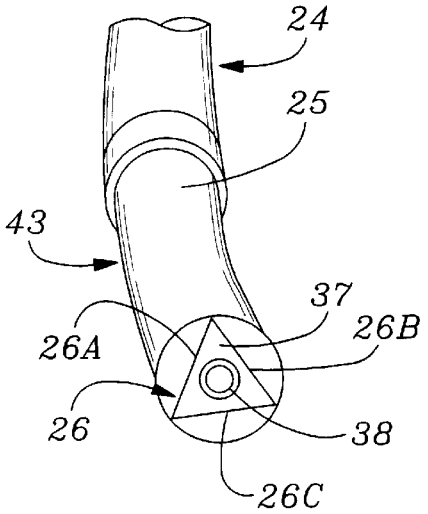
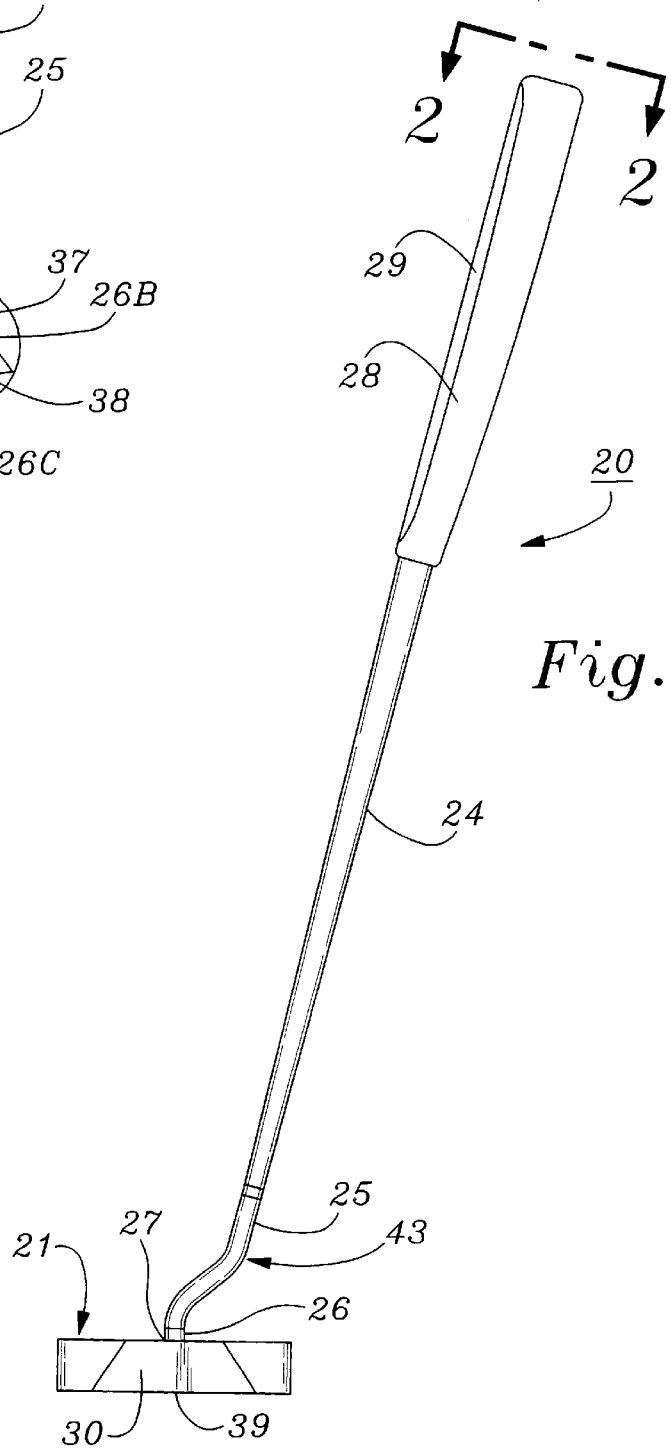
Fig. 1

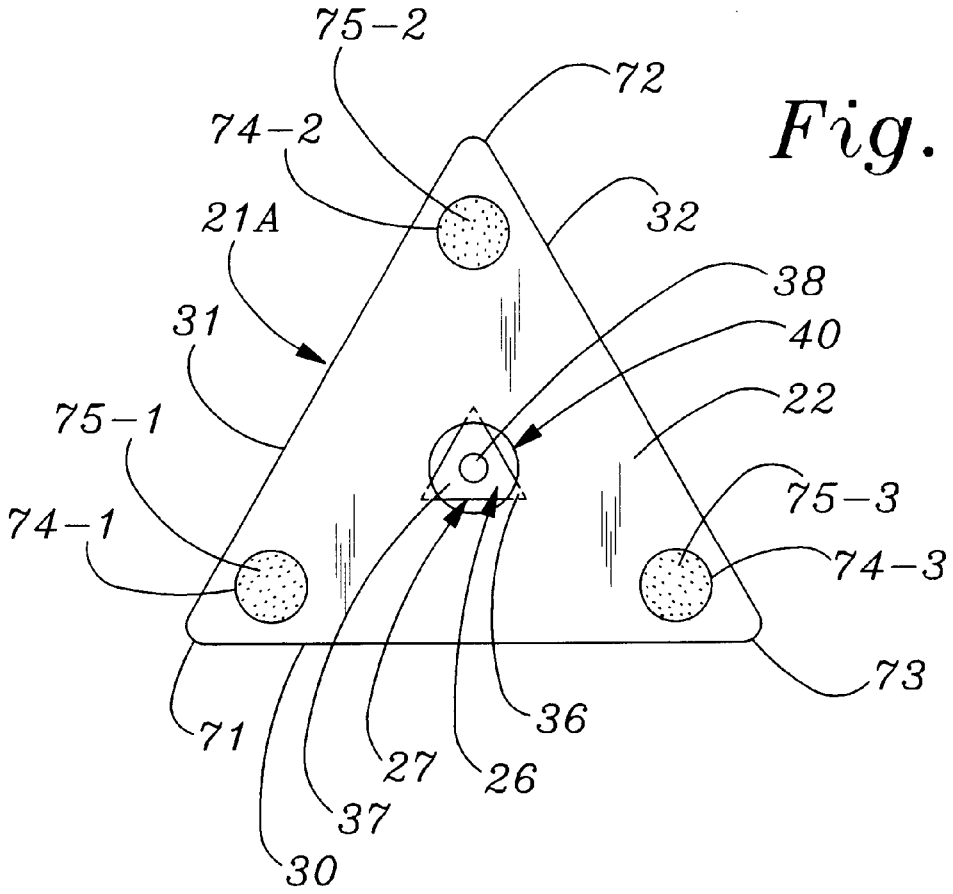
Fig. 12
Fig. 13
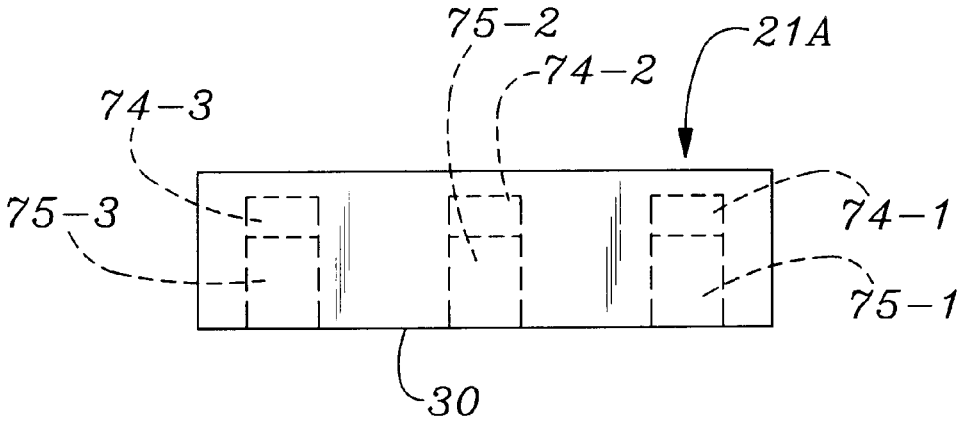

GOLF PUTTER WITH POLYHEDRAL HEAD AND ROTATABLY SELECTABLE TRACTION CONTROL FACES

BACKGROUND OF THE INVENTION

A. Field of the Invention

The present invention relates to golf clubs. More particularly, the invention relates to an improved golf putter having a polyhedrally-shaped head, rotatable to keyed orientations relative to a shaft, and having traction control inserts of varying properties at different faces of the head.

B. Description of Background Art

In theory, golf is a simple game, merely requiring that the player advance a ball from a tee located at the beginning of a fairway into a cup or "hole" located on a green at the end of a fairway, by successively hitting the ball with selected clubs a minimum number of times, or strokes. This progression from tee to green is repeated for the nine or eighteen seriatim fairways or holes which the particular golf course is segmented into. In practice, however, the game of golf can be very frustrating, for a number of reasons.

For long "holes," beginning golfers frequently experience problems with their "long game," i.e., have difficulty in hitting the ball squarely with sufficient force to traverse the fairway from tee to green with a minimum number of strokes. However, for most people that are not physically handicapped, a facility for hitting "long" balls can be developed in a relatively short time, by practicing at driving ranges, for example. On the other hand, beginning golfers often find that, although the skills required to advance the ball from the tee to the vicinity of the green in a reasonable number of strokes can be achieved in a relatively short time, "holing" the ball in the cup can add sufficient strokes to far exceed "par," the idealized, average number of strokes determined to be achievable by expert golfers playing the same hole.

Oftentimes, beginning golfers add excessive strokes to their game because of difficulties experienced in putting the ball into the cup from distant locations on the green. Putting difficulties can arise from the fact that a different set of motor skills are required for putting than for driving the ball from the tee, or hitting long fairway shots. The latter require expenditure of substantial amounts of kinetic energy by the golfer in imparting enough momentum to the ball to propel it for long distances. In putting, raw power or brute force is ineffectual, and the beginning golfer must acquire a substantial amount of finesse in hitting a ball residing on the green, to avoid overshooting the cup and adding unwanted strokes to his game.

Since the amount of momentum that must be imparted to a putted ball is so much less than required to drive a ball appreciable distances, beginning golfers often "pull" their club on short putts, i.e., fail to follow through on their stroke. This pulling or "choking" is detrimental, since the directional control of the impacted ball is adversely affected by such actions. Accordingly, many beginner golfers are confronted with the frustrating situation of putting the ball with good accuracy but beyond the cup, when utilizing their newly acquired skills for long-ball hitting with appropriate follow-through in their stroke. Conversely, choked or pulled strokes can result in the putted ball stopping short of the cup, or deviating substantially away from the cup.

The putting difficulties alluded to above are exacerbated by the substantial variations normally encountered in the conditions of greens. Thus, greens on which the grass is closely trimmed and dry offer minimum rolling resistance to a golf ball, and are "fast." Conversely, greens on which the grass is long and/or wet present substantial rolling resistance to a rolling golf ball, and are "slow." Therefore, the exact amount of momentum that must be delivered to hole a ball varies substantially as a function of green conditions, as well as with distance from the cup.

In recognition of the problems encountered with putting by beginners as well as even relatively experienced golfers, the present inventor disclosed a novel putter design to improve putting skills, in U.S. patent application Ser. No. 08/416,135 filed Apr. 5, 1995, now U.S. Pat. No. 5,458,332, issued Oct. 17, 1995, for a Golf Putter Head With A Cushioning Face. That application discloses heads having on the front face thereof a polymer pad having a rebound factor directly related to the distance to an intended target. For short putts and/or fast greens, a small rebound factor of, say 12.5% was disclosed as being desirable for puffs of about 10 feet, 25% for 15–20 foot putts, 37.5% for putts of about 30 feet, and 50% for putts of 40 feet or greater.

By selecting a particular putter from a series of putters fitted with inserts having different rebound factors, the disclosed invention enabled golfers to utilize strokes that varied over a smaller power range, even for widely varying putting distances and green conditions. For example, by using a putter having an insert with a low rebound factor of 12.5%, the ball may be struck with nearly the same vigor for a 10 foot putt as for a 40 foot putt using a putter having a higher rebound factor of 50%. Therefore, the player can use a complete stroke with the follow through required for accurately launching the ball towards the cup, even for short putts and/or fast greens, by using a putter having an insert with an appropriately low rebound factor.

In addition to the substantial contribution to improved putting afforded by putters having inserts with rebound factors optimized to various putting situations, the present inventor's prior application disclosed putters in which the rebound factor of an insert could be varied somewhat independently of hardness. This capability permits the feel of the club upon impacting the ball to be adjusted somewhat, thus allowing inserts with varying rebound factors to provide similar sensory feedback upon impacting a golf ball.

The golf putter heads described in the present inventor's U.S. Pat. No. 5,458,332 referred to above provided a substantial contribution to improving a golfer's putting performance. However, a problem still existed for golfers approaching the green.

In the "short" portion of a golf game, it is usually necessary to hit the ball onto the green from a fairway, rough or sand trap. Such locations are oftentimes well within a golfer's maximum distance hitting capability. Accordingly, clubs with an inclined front face that provide a substantial vertical component (loft) to the ball trajectory are often used in approaching the green. A high trajectory minimizes the likelihood of overshooting the green, and results in the ball impacting the green at a relatively steep angle, thereby minimizing roll away from the impact point. In spite of making a careful choice of the best club to prevent exceeding a desired horizontal range, many players are confronted in their short games with the same dilemma as in putting; namely, maintaining normal swing and follow through to achieve good trajectory direction, and possibly overshooting an intended impact point, or pulling the shot to decrease horizontal range, while adversely affecting angular or bearing accuracy, and/or falling short of a desired impact point.

In view of the problems alluded to above, it occurred to the present inventor that some of the novel improvements which he disclosed in his U.S. Pat. No. 5,458,332, for putters might be adapted to other varieties of golf clubs, including wedges and other irons, as well as woods. Such considerations were in part a motivation for further inventions by the present inventor, which were disclosed in U.S. patent application Ser. No. 08/543,813, filed Oct. 16, 1995, now U.S. Pat. No. 5,674,132, issued Oct. 7, 1997 for a golf club head with a rebound control insert.

In the course of applying the improvements in putter construction disclosed in the '332 patent to other types of golf clubs, it was found that the larger ball impact forces typically encountered in using the latter suggested a somewhat more rugged design, to ensure that the polymeric insert on the club face could be attached securely to a club head, and by a relatively simple manufacturing technique. As it turned out, the newly conceived design for improved woods and irons turned out to be advantageously useable with the putter head design previously disclosed by the present inventor.

Following the aforementioned advancements in golf club design, the present inventor conceived a golf putter including a head provided with an insert which may be readily interchanged to provide different rebound factors and/or hardness, resulting in issuance of U.S. Pat. No. 5,921,871, Golf Putter Head With Interchangeable Control Insert. The golf putter disclosed in the '871 patent includes a head having at the front face thereof a resilient rebound control pad secured to the head by releasable fastening means that permit interchanging the pad with a pad which provides a different rebound factor and/or hardness. Thus, the putter disclosed in the '871 patent enables different rebound factors to be selected to suit a player's particular putting style. For example, a consistently heavy hitter might choose a lower rebound factor, to avoid overstroking a hole. On the other hand, the same player might choose a higher rebound factor for use on a particular day at a particular course when the greens were slower, because the grass was wet and/or longer. Different hardness values may also be selected to provide a different feel upon impacting a ball.

The present invention was conceived of to provide a golf putter including a head provided with a plurality of faces having differing ball impact characteristics such as rebound, hardness or traction control, the head being rotatable with respect to a shaft and fixable at discrete, keyed orientations with respect to the shaft, to position a selected face at the front of the putter.

OBJECTS OF THE INVENTION

An object of the present invention is to provide a golf putter including a head provided with a plurality of ball-striking faces, each having differing ball impacting characteristics, the head being rotatable to predetermined keyed orientations with respect to the longitudinal axis of a shaft and fixable thereat to place a selected face at a ball-striking position.

Another object of the invention is to provide a golf putter including a head having a polygonal plan view shape, and a plurality of vertically disposed faces having differing ball impacting characteristics, and a shaft selectably fixable at keyed orientations to the head to place a selected face at a ball-striking position perpendicular to the intended swing direction of the shaft.

Another object of the invention is to provide a golf putter including a head having aa polygonal plan view shape and a plurality of generally vertically disposed faces having differing ball impacting characteristics, the head having in an upper surface thereof a polygonal cross section bore having faces parallel to the ball impacting faces, and a shaft having at the lower end thereof a keyed end shaped complimentarily to the bore, whereby the shaft may be removably inserted into and secured within the bore to position a selected face of the head perpendicular to a portion of a grip located at the upper end of the shaft, which defines a plane in which the shaft is intended to be swung to impact a ball.

Another object of the invention is to provide a golf putter including a head having in plan view the shape of a regular polygon, a plurality of generally vertically disposed faces having differing ball impacting characteristics, a bore in the center of an upper surface of the head which has polygonal walls parallel to the ball impacting faces, and a shaft having an upper grip end provided with a thumb flat defining the intended swing plane of the club, and a lower end shaped complimentarily to the bore, thereby enabling the shaft to be insertably received within the bore to secure the head to the shaft with a selectable face oriented parallel to the thumb flat.

Another object of the invention is to provide a golf putter including a head having in plan view a polygonal shape, a plurality of faces fitted with inserts having differing ball impacting characteristics, and a shaft removably attachable to the head at selected keyed locations to orient a selected insert at a front ball impacting location relative to the shaft.

Another object of the invention is to provide a golf putter, including a head having a plurality of ball faces which are provided with inserts having differing ball impacting characteristics.

Another object of the invention is to provide a golf putter including a head having a plurality of faces which are selectably orientable to an intended swing direction and which are provided with inserts having different ball impacting characteristics, including an insert having a heterogeneous composite composition which includes grains of a harder material held within a polymer matrix.

Another object of the invention is to provide a golf putter including a head having a plurality of faces which are selectably orientable to a position perpendicular to an intended swing direction of the putter, the faces having located at intended ball impacting regions thereof inserts having differing ball impacting properties, including an insert having a composite composition which includes grains of metal held within a polymer matrix.

Another object of the invention is to provide an insert for a golf club face which has a heterogeneous composite composition which includes grains of a property-altering material in a polymer matrix.

Another object of the invention is to provide an insert for the ball impacting face of a golf club which has a composite composition which includes a polymer matrix in which is intermingled grains of metal or a refractory material to vary the traction, hardness or rebound factor of the insert.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described in this specification are merely illustrative of the preferred embodiment. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved golf putter which includes a multi-face head that is removably attachable to a shaft in selected ones of a plurality of keyed orientations which position a selected face of the head in a front, ball-striking disposition relative to the shaft, e.g., relative to a flat on the hand grip at the upper end of the shaft which a player may align his or her thumbs with to define a plane in which the putter is swung to impact and drive a golf ball towards a hole. Each face of the head preferably has different ball impacting characteristics, allowing a golfer to select different faces for different playing conditions.

In preferred embodiments of the invention, the head has a generally polyhedral shape, including a polygonally-shaped base, a plurality of generally vertically disposed faces which depend upwardly from the base, and a polygonally-shaped upper wall surface vertically aligned with the base. Preferably, the base has a generally flat surface, which may be slightly convex to minimize scuffing contact with a green when the putter is swung, the upper surface is generally flat and parallel to the base, and the faces are generally rectangularly-shaped and perpendicular to the base and upper wall surface of the head. Thus, preferred embodiments of the head have the shape of a prism, and the head has in plan-view the shape of a regular polygon. In a particular preferred embodiment, the putter head plan-view shape is that of an equilateral triangle, thus provided three vertical faces which may have different ball impacting characteristics. Other embodiments of the invention have regular polygonal shapes such as square or hexagonal, providing four or six selectable ball impacting faces. Moreover, the head may have an elongated, thin rectangular plan-view shape, provided with front and rear faces which have different ball impacting characteristics.

Putters according to the present invention, include means for removably attaching the putter head to the shaft at a selected one of a plurality of predetermined, keyed polar or azimuthal angles relative to the longitudinal axis of the shaft. A preferred keyed attachment means includes a bore which protrudes perpendicularly downwardly into the head from the upper wall surface of the head. The bore is coaxial with a central altitude of the head, and has a plurality of vertical walls which are parallel to the faces of the head. Thus, for example, an example embodiment of the invention includes a head having in plan view the shape of an equilateral triangle having sides about 3½ inches long, and a centrally located bore having in cross section the shape of an equilateral triangle which sides are about ¼ inch long and parallel to respective vertical sides of the head.

In preferred embodiments of the putter according to the present invention, the keyed attachment means for removably attaching the shaft to the head includes a prismatic-shaped boss, e.g., an equilateral triangle prism, which protrudes downwardly from the lower end of the shaft, the boss having a shape complimentary to that of the bore in the upper wall of the head. With this arrangement, the shaft boss is inserted into the head bore with the head oriented to position a selected face at a front, ball-striking location relative to the shaft grip. The shaft and head are then secured together, as for example, by a screw inserted into a countersunk entrance to the head bore located in the lower or sole surface of the head and threaded into an internally threaded, blind bore provided in the lower end of the prismatic shaft boss.

Also in a preferred embodiment of the invention, each vertical face of the head which is selectable as a ball-striking face has different ball impacting characteristics. Preferably, these differing characteristics are provided by inserts having different ball control properties, particularly rebound and/or hardness. Such insert technology is described fully in the present inventor's U.S. Pat. Nos. 5,458,332, 5,674,132, and 5,921,871, and the disclosures of those three patents are hereby incorporated by reference into the present disclosure.

In addition to various rebound and hardness values, at least one face insert in each putter head according to the present invention also preferably is of a novel construction which provides further selection and control of the ball control characteristics described in the aforementioned three patents. Thus, the present inventor has found that fabricating polymer inserts in which grains of a hard material such as metal grains or, grains of a refractory material such as aluminum oxide or a carbide such as silicon carbide, enhances the traction of the insert relative to a golf ball, thus minimizing slippage between the insert surface and a golf ball surface when the ball is struck, and thereby insuring the desired amount of spin is imparted to the ball upon impact. Moreover, the present inventor has discovered that fabricating polymer inserts as a heterogeneous, multi-phase composite including a polymer matrix and discrete grains of metal or a refractory material, provide a convenient means for adjusting both hardness and rebound factors more readily than achievable by varying the properties of just the polymer.

BRIEF DESCRIPTION OF THE DRAWINGS

FIG. 1 is a front elevation view of a golf putter according to the present invention.

FIG. 2 is a fragmentary end view of the putter of FIG. 1, taken along line 2—2.

FIG. 11 is a fragmentary lower plan view of the shaft of FIG. 12.

FIG. 12 is a lower plan view of a modification of the putter head of FIGS. 1–13.

FIG. 13 is a rear elevation view of the modified putter head of FIG. 14.

DETAILED DESCRIPTION OF THE PREFERRED EMBODIMENTS

Figure 14:
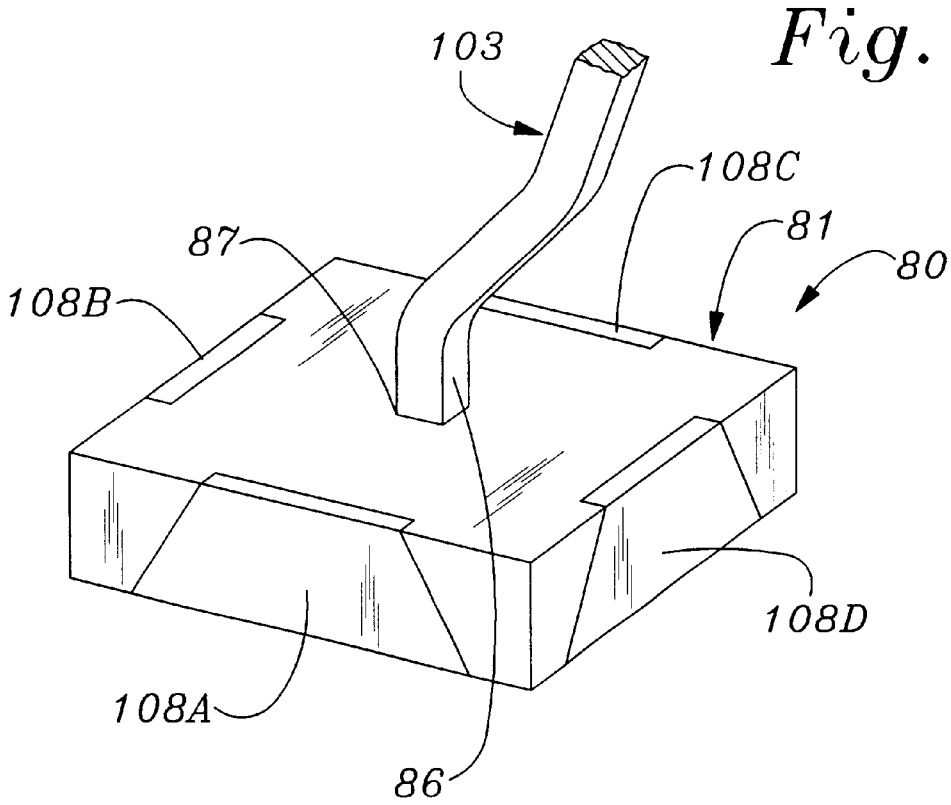
FIG. 14 is an upper plan view of a first variation of a putter according to the present invention.
Figure 15:
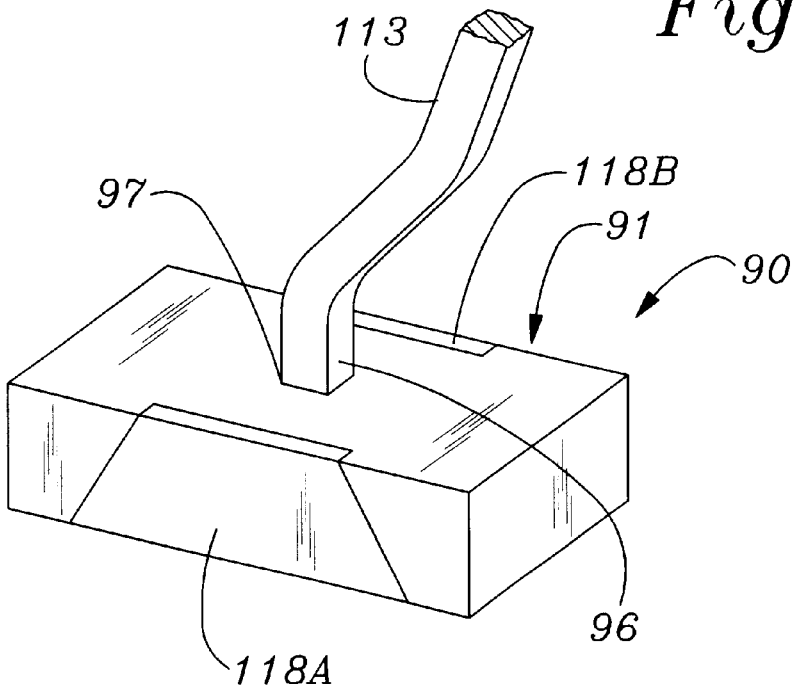
FIG. 15 is an upper plan view of a second variation of a putter according to the present invention.

FIGS. 1–11 illustrate a basic embodiment of a golf putter with polyhedral head and rotatably selectable traction control faces according to the present invention. FIGS. 12 and 13 illustrate a modification of the putter head of FIGS. 1–11. FIGS. 14 and 15 illustrate two variations of a putter according to the present invention.

Referring first to FIGS. 1–7, a particular embodiment of a golf putter with polyhedral head and rotatably selectable traction control faces 20 according to the present invention may be seen to include a head 21 comprising a polyhedrally-shaped body having generally flat and parallel lower and upper surfaces 22, 23 respectively. Putter 20 includes an elongated shaft 24 which is straight over most of its length, but which has a crooked lower end portion 25, terminated by a lower straight boss section 26 which is insertably received in a bore 27 that extends perpendicularly downwards into head 21 from upper surface 23 of the head. Shaft 24 is made conventionally of tubular stainless steel or a composite material and also has an upper hand grip portion 28, which is conventionally made of a relatively softer material such as leather or an elastomeric polymer which enables the grip to be firmly yet comfortably gripped by the hands of a golfer. Preferably, grip 28 has a generally oval cross section, modified by a flat portion 29 on which the thumbs may be placed to define a plane in which the putter is swung to impact a golf ball.

As shown in FIG. 1, putter head 21 has the shape of a short equilateral triangular prism, which includes three horizontally elongated, rectangularly-shaped faces 30, 31 and 32. As will be described later, head 21 may optionally have other polyhedral shapes, such as square and rectangular, as shown in FIGS. 14 and 15, respectively.

Figure 7:
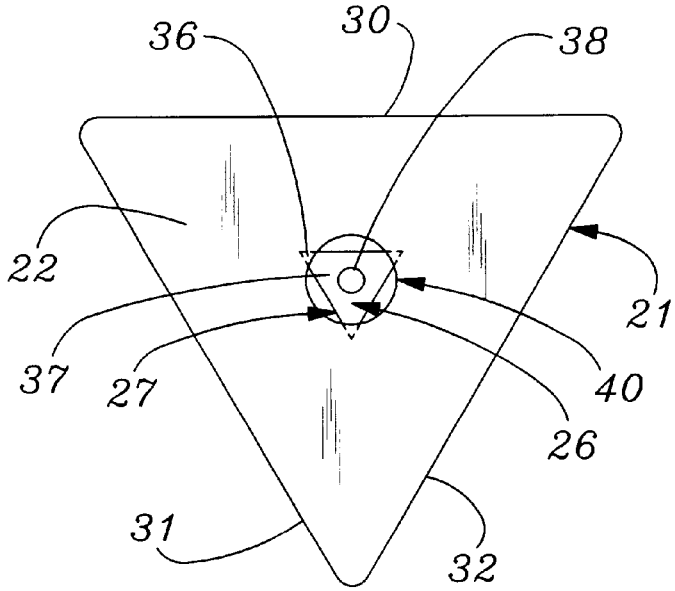
FIG. 7 is a fragmentary lower plan view of the putter of FIG. 1, on an enlarged scale.
Figure 8:
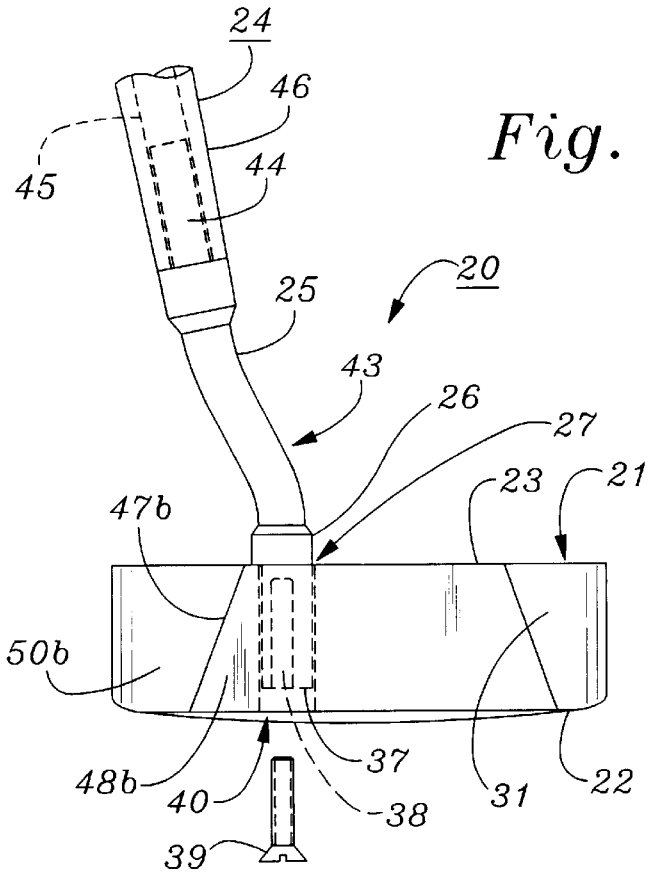
FIG. 8 is a fragmentary oblique left side elevation view of the putter of FIG. 1, on an enlarged scale and taken perpendicular to a face of the putter head.
Figure 9:
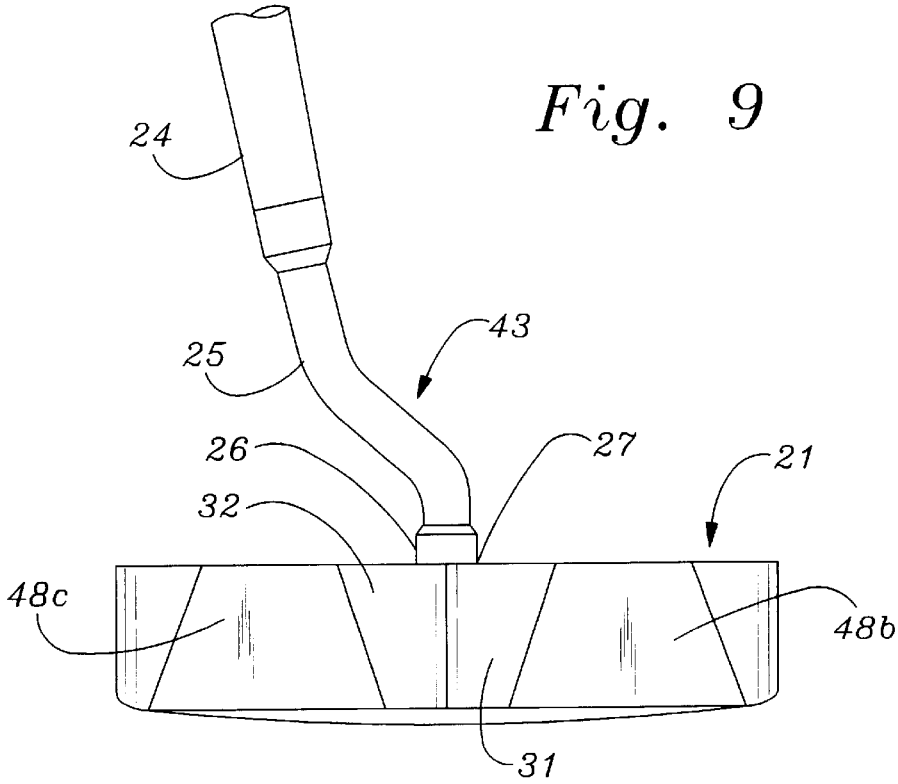
FIG. 9 is a fragmentary rear elevation view of the putter of FIG. 8.

As shown in FIGS. 8 and 9, lower surface 22 of putter head 21 is preferably slightly convex, to minimize drag forces exerted on the head as it is swung above a green to impact a golf ball. Thus, as shown in FIGS. 7, 8 and 9, lower surface 22 of head 21 has in elevation view a generally circular arc shape, the vertex of the arc coinciding with the geometric center 33 of lower surface 22 of the head.

In the embodiment of golf putter 20 shown in FIGS. 1–11, faces 30, 31, 32 of head 21 are preferably vertically disposed, i.e., perpendicular to upper and lower surfaces 23 and 22 of the head. Thus disposed, faces 30, 31, 32 are inclined at a zero degree loft angle. Optionally, one or more of faces 30, 31, 32, may be inclined at different positive or negative loft angles, e.g., ±1 degrees, ±2 degrees, etc.

In an example embodiment a putter 20 of the type shown in FIGS. 1–11, putter head 21 had a height of about 1 inch, and sides about 3½ inches long.

Figure 5:
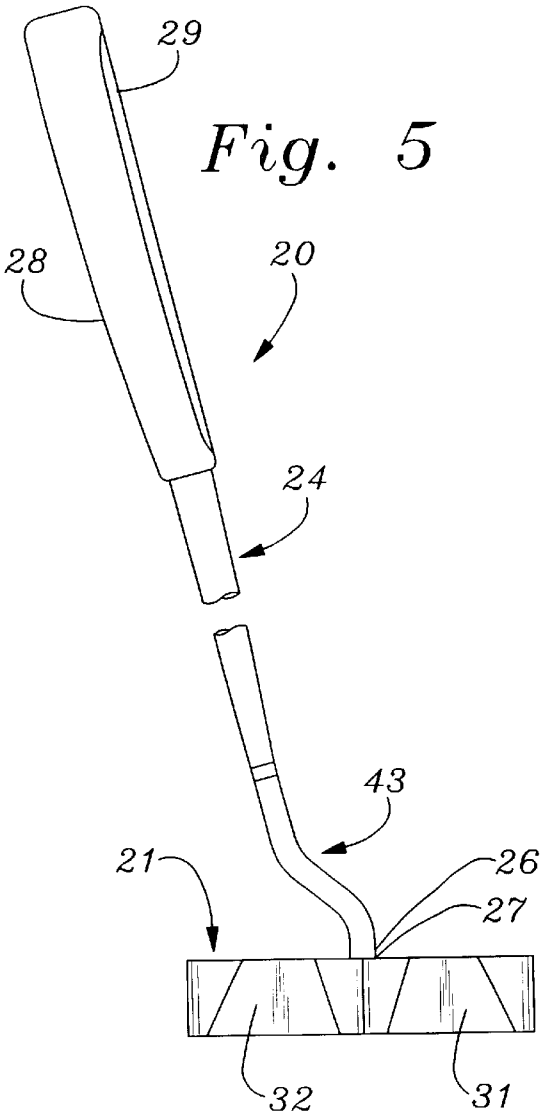
FIG. 5 is a rear elevation view of the putter of FIG. 1.
Figure 4:
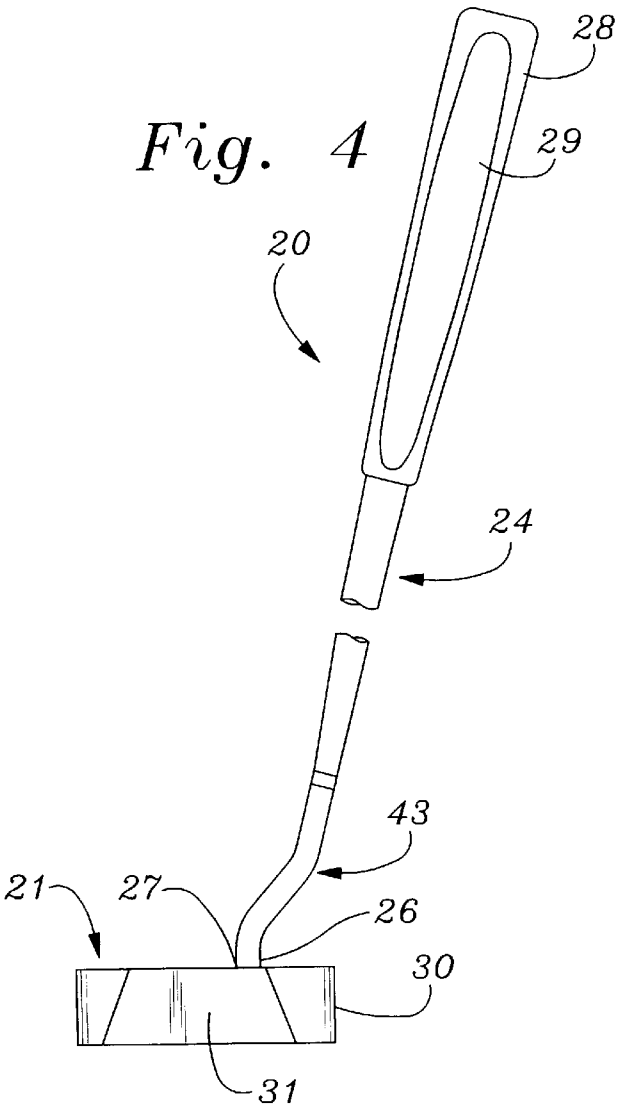
FIG. 4 is a left side elevation view of the putter of FIG. 1.
Figure 3:
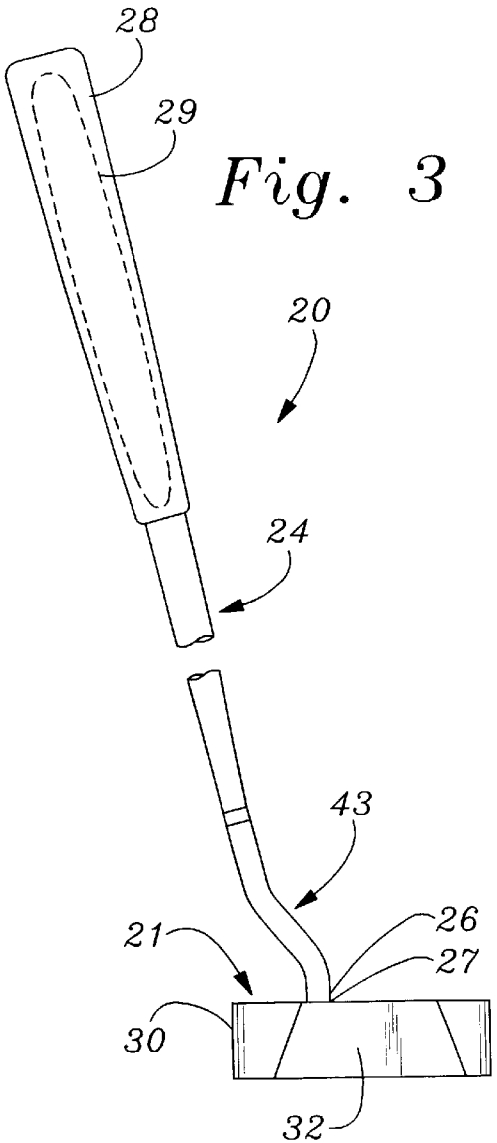
FIG. 3 is a right side elevation view of the putter of FIG. 1.
Figure 6:
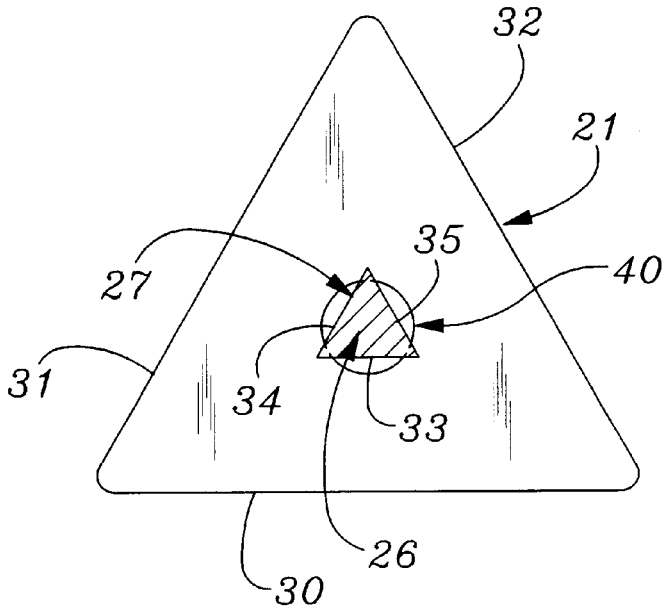
FIG. 6 is a fragmentary upper plan view of the putter of FIG. 1, on an enlarged scale.

Referring now to FIGS. 6, 7 and 8, it may be seen that shaft attachment bore 27 in putter head 21 is concentric with a central altitude of putter head 21, and has a shape geometrically similar to the upper plan view of the head. Thus, as shown in FIG. 10, shaft attachment bore 27 has an equilateral triangular shape, including bore faces 33, 34, 35 which are parallel to ball impacting faces 30, 31, and 32, respectively.

Figure 10:
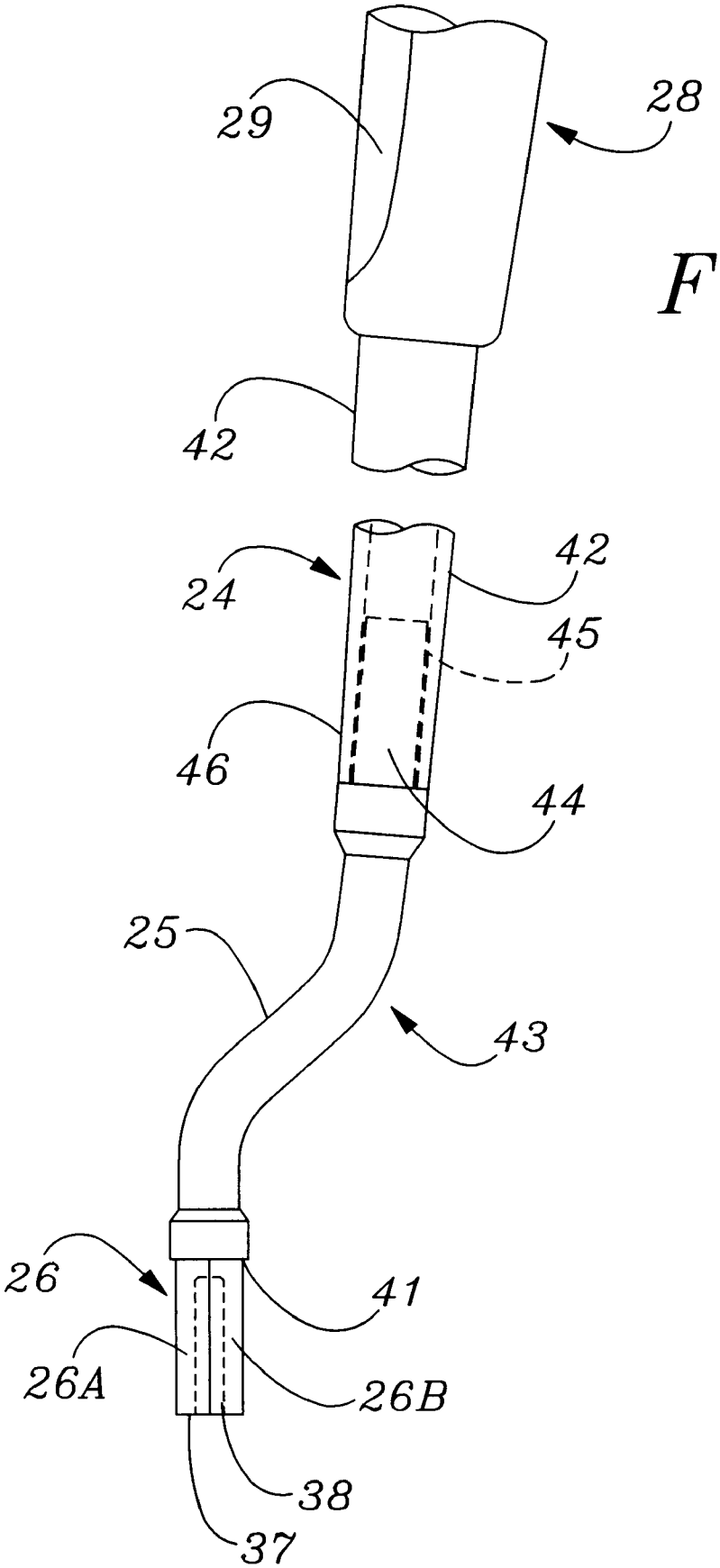
FIG. 10 is a fragmentary exploded right side elevation view of the putter of FIG. 1 on an enlarged scale showing the shaft removed from the head.

As shown in FIGS. 10, and 11, lower straight boss section 26 of shaft 24 has a triangular cross section shaped similarly to that of triangular attachment bore 27 in head 21. Thus, as shown in FIG. 11, lower boss section or shaft end 26 has the shape of a vertically elongated triangular prism with three vertically elongated, rectangularly-shaped side faces 26*a*, 26*b*, 26*c*, respectively. Side faces 26*a*, 26*b*, 26*c*, of shaft end 26 are oriented so as to position a club head face 30, 31, or 32 perpendicular to grip flat 29 when the shaft end is installed in bore 27 of head 21. Thus, as shown in FIG. 10, shaft end face 26*a* is approximately perpendicular to flat portion 29 of shaft grip 28, and side faces 26*b* and 26*c* are oriented at angles of 60 degrees and 120 degrees clockwise relative to side 26*a*, as viewed from above the grip. With this arrangement, prismatic shaft end 26 of shaft 24 may be inserted within bore 27 in head 21 with side 26*a* of the shaft end parallel to first vertical ball impacting face 30 of the head, to thereby locate the ball impacting face forward of the shaft and perpendicular to the plane of flat 29 of grip 28, at a conventional ball impacting location relative to the shaft. If it is desired to locate a different face of head 21, having different ball impacting characteristics such as second ball impacting face 31, at the front ball impacting location, shaft end 26 may be withdrawn from bore 27 in head 21, rotated sixty degrees clockwise, and reinserted into the bore. Similarly, if it is desired to locate the face 32 of head 21 at the front ball impacting location relative to shaft flat 29, shaft 24 may be once again withdrawn from head bore 27, rotated another 60 degrees, and reinserted into the bore.

With end 26 of shaft 24 inserted into bore 27 of head 21 in a desired one of the three orientations described above, the shaft is secured to the head. Thus, as shown in FIGS. 7 and 8, bore 27 in head 21 is provided with a radially inwardly protruding ledge or shoulder 36 near the bottom surface 22 of the head, to provide a seat on which the lower transverse surface 37 of prismatic shaft end boss 26 may rest. As shown in FIGS. 7, 8, and 11, an internally threaded bore 38 is disposed coaxially upwards into shaft end 26 from lower surface 37 thereof. With this arrangement, shaft 24 may be removably secured to head 21 by a flat head screw 39 inserted into a counter bored lower entrance opening 40 to bore 27, located in lower surface 22 of head 21. As shown in FIG. 10, shaft 24 preferably has formed at the junction between the lower end of crooked portion 25 of the shaft and the upper end of prismatic boss portion 26 of the shaft, a radially outwardly protruding circular flange 41 having a larger radius than the triangular boss portion, thus providing a surface which seats against upper surface 23 of head 21, and which limits the insertion depth of the shaft end into head bore 27. In a preferred embodiment, prismatic boss 26 and crooked end 25 of shaft 24 are fabricated as a unitary structure separate from the straight, upper tubular portion 42 of shaft 24. Thus constructed, lower straight and crooked portions 26 and 25 are combined into a hosel 43, the upper end 44 of which is secured within a longitudinal bore 45 in the lower end portion 46 of shaft 24, by conventional means such as an adhesive bond or set screw.

The novel design and construction of golf putter 20 described above enables faces 30, 31, 32, to be selectably positioned forward of shaft 24, in a ball impacting location. According to the invention, some and preferably all of the faces 30, 31, 32, have different ball impacting characteristics, which may be selected by a golfer to suit particular playing conditions. In preferred embodiments of putter 20, faces 30, 31, and 32 are fitted with different inserts having different ball-impacting characteristics. Thus, as shown in FIGS. 8 and 9, each face 30, 31, 32 of putter head 20 has formed therein a recess 47*a*, 47*b*, 47*c*, respectively, which extends inwardly into the head. Recesses 47*a*, 47*b*, 47*c* are provided to receive inserts 48*a*, 48*b*, 48*c* having an outline shape and size similar to that of the recess, and a thickness approximating the depth of the recess, so that the front surface 49 of the insert will fit flush with front surface 50*a*, 50*b*, 50*c* of face 30, 31, 32. Each insert 48*a*, 48*b*, 48*c* preferably has a different rebound characteristic and/or hardness, thus providing to a golfer different ball roll distances for equivalent swing momentums, and/or different tactile sensations or "feel" upon impacting a golf ball. As described in detail in the present inventor's U.S. Pat. Nos. 5,458,332, 5,674,132, and 5,921,871, the disclosure of each of which patents are incorporated by reference into the present specification, inserts 48*a*, 48*b*, 48*c* are preferably each fabricated from a thin sheet of polymeric material, such as polyurethane, having a uniform thickness and controlled rebound characteristic and hardness.

In preferred embodiments of the present invention, at least one additional ball impacting characteristic of at least one of the plurality of face inserts is varied. Specifically, the present inventor has found that adding small particles of metal such as aluminum, or of a refractory material such as aluminum oxide or a carbide such as silicon carbide to a polymeric insert, causes the insert to adhere better to a golf ball upon impact, thereby providing better control of the amount of spin imparted to the ball. In an example embodiment of such insert tested by the present inventor, 3–5 parts of silicon carbide by weight were added to 20 parts of a liquid polymer melt, such as polyurethane prior to solidification of the liquid polymer melt into a cured, elastomeric state. The approximate screen grit size of the silicon carbide grains used was 80 grit. Particles of metal or refractory material in the approximate size range of 24 grit to 180 grit may also be used, while a size range of 60 grit to 120 grit is preferred.

During the course of testing inserts fabricated as a composite multi-phase structure including a polymeric matrix holding in suspension metal or refractory material grains, as described above, the present inventor discovered that addition of metal or a powdered refractory material to polymer inserts also changes both the hardness and rebound factor, enabling these latter two properties to be varied over a wider range than the ranges achievable by varying the properties of just the polymer.

FIGS. 12 and 13 illustrate a modification of the putter head shown in FIGS. 1–11. As shown in FIGS. 12 and 13, modified putter head 21A has proximate each of three vertices 71, 72, 73, of lower surface 22 thereof a perpendicularly upwardly disposed blind bore 74-1, 74-2, 74-3, in which is secured a cylindrical weight 75-1, 75-2, 75-3, respectively, made of a material having a greater specific gravity than that of head 21*a*. Thus, for example, with head 21*a* made of aluminum, weights 75 are typically made of lead or tungsten. For any face oriented to a ball impacting disposition, such as face 30, weights at opposite ends of the face, such as weight 75-1, 75-3, provide substantially greater toe and heel weighting of head 21A than possessed by head 21, which has a homogeneous body construction. Thus, weights 75-1, 75-3 increase the polar moment of inertia of head 21A about the central longitudinal axis of the head, over that of head 21. The increased polar moment inertia is desirable, since it increases the torque required to inadvertently rotate the head when the putter is swung, which rotation is undesirable because it results in impacting the ball obliquely rather than squarely. Moreover, the novel design of putter heads 21 and 21A locates a third substantially large mass at a substantially large radial distance from the axis of the head, perpendicularly rearward from a front ball impacting face, thus further increasing the polar moment of inertia of head 21, and to a greater extent, head 21A.

FIGS. 14 and 15 illustrate variations 81 and 91 of putter head 21 according to the present invention, which have four and two selectable ball striking faces, respectively. According to the present invention, faces of putter head 21 may also have different loft angles affording further selectability by a golfer of ball impacting characteristics.

What is claimed is:

1. A golf putter comprising;

d. a head having a base and a plurality of faces protruding upwardly therefrom, at least one of said faces which has different ball impacting characteristics than another of said faces, e. an elongated shaft including an upper grip portion, and f. attachment means releasably securing said shaft to said head at a fixed a relative orientation which positions a selected one of said faces in a position relative to said shaft grip for impacting a golf ball on a surface and propelling said ball in an intended direction relative to said surface when said putter is swung, said attachment means comprising in combination, (i) a head bore extending downwardly into said head from an upper surface thereof, said head bore having a polygonal cross-sectional shape, (ii) a boss protruding downwardly from a lower end portion of said shaft, said boss having a polygonal cross-sectional shape similar to that of said head bore whereby said boss is insertably and irrotatably receivable within said head bore, and (iii) releasable fastener means for securing said boss within said head bore, whereby said fastener means is releasable to enable said shaft boss to be withdrawn from said head bore, said head rotated about a vertical axis of said bore to thereby position any of said faces in a front ball striking disposition relative to said shaft, said shaft boss re-inserted into said head bore and re-secured to said head.

2. The putter of claim 1 wherein said head is further defined as having a generally polyhedral shape, including a generally flat base having in plan view the shape of a polygon, a plurality of walls which depend upwardly from sides of said polygon and comprise said plurality of faces, and an upper wall surface having in plan view a shape similar to and vertically aligned with said base.

3. The golf putter of claim 1 wherein said releasable fastener means is further defined as comprising in combination a threaded member received upwardly from said base of said head into said head bore, and an internally threaded bore in said boss of said shaft threadingly engaged by said threaded member.

4. The golf putter of claim 1 wherein at least one of said faces has a different loft angle than another of said faces.

5. The golf putter of claim 1 wherein at least one of said faces has at an intended ball impacting region thereof an insert which has a hardness different than that of another of said faces.

6. The golf putter of claim 1 wherein at least one of said faces has at an intended ball impacting region thereof an insert which in combination with said head provides a composite rebound factor which imparts to a ball impacted by said face at a particular swing velocity a momentum different than that imparted to said ball impacted by another of said faces at the same swing velocity.

7. The golf putter of claim 1 wherein at least one of said faces has at an intended ball impacting region thereof a traction control insert which has a coefficient of friction with respect to a golf ball different than a coefficient of friction between said ball and another of said faces.

8. The golf putter of claim 1 wherein said traction control insert is further defined as including a polymer matrix in which are imbedded grains of a material harder than said polymer.

9. The golf putter of claim 8 wherein said grains are further defined as being a metal.

10. The golf putter of claim 8 wherein said grains are further defined as being a refractory material.

11. The golf putter of claim 10 wherein said refractory material is further defined as being aluminum oxide.

12. The golf putter of claim 10 wherein said refractory material is further defined as being a carbide.

13. The golf putter of claim 12 wherein said carbide is further defined as being silicon carbide.

14. The golf putter of claim 13 wherein said silicon carbide grains have an approximate size in the range of 24 grit to 180 grit.

15. The golf putter of claim 14 wherein said polymer is further defined as being polyurethane.

16. The golf putter of claim 15 wherein said insert is further defined as having about 3–5 parts by weight of silicon carbide dispersed in a polyurethane matrix having a pre-cured liquid polymer melt weight of about 20 parts.

17. A golf putter comprising;

a. a head comprising a body having a generally polyhedral shape, said body having a generally flat base having in plan view the shape of a polygon, a plurality of side walls which depend upwardly from sides of said polygon, at least two of which side walls comprise a plurality of ball impacting faces, an upper wall surface having in plan view sides which define an upper polygon similar to said base polygon, and a head bore extending downwardly into said body from said upper surface thereof, said head bore having a polygonal cross-sectional shape similar to the outline shape of said upper wall surface of said head, and having side faces parallel to said ball impacting faces, b. an elongated shaft including an upper grip portion and a longitudinally elongated, prismatic-shaped boss protruding downwardly from a lower end portion of said shaft, said boss having a polygonal cross-sectional shape similar to that of said cross-sectional shape of said head bore and adapted to be insertably and irrotatably received within said head bore, and c. means for releasably securing said boss within said head bore.

18. The golf putter of claim 17 wherein said polygonal shape of said boss of said shaft is further defined as being a regular polygon.

19. The golf putter of claim 17 wherein said polygonal shape of said boss of said head is further defined as being an equilateral triangle.

20. The golf putter of claim 19 wherein said body of said head is further defined as having proximate each of three vertices of said base thereof an upwardly disposed bore in which is secured a weighting member made of a material having a specific gravity different from that of said body.

21. The golf putter of claim 17 wherein at least one of said ball impacting faces has a different ball impacting characteristics than another of said ball impacting faces.

22. The golf putter of claim 21 wherein said polygonal cross section of head bore is further defined as being in parallel alignment with perimeter walls of said polygonally-shaped upper wall surface of said head.

23. The golf putter of claim 22 wherein said polygonal shape of said boss of said shaft is further defined as being a regular polygon.

24. The golf putter of claim 22 wherein said polygonal shape of said base of said head is further defined as being an equilateral triangle.

25. The golf putter of claim 22 wherein said polygonal shape of said base of said head is further defined as being a rectangle.

26. The golf putter of claim 22 wherein at least one of said ball impacting faces has a different loft angle than another of said faces.

27. The golf putter of claim 22 wherein at least one of said faces has at an intended ball impacting region thereof an insert which has a hardness different than that of another of said faces.

28. The golf putter of claim 22 wherein at least one of said faces has at an intended ball impacting region thereof an insert which in combination with said head provides a composite rebound factor which imparts for a given swing velocity a momentum to a ball impacted by said face different than momentum imparted to said ball when impacted at said velocity by another of said faces.

29. The golf putter of claim 22 wherein at least one of said faces has at an intended ball impacting region thereof a traction control insert which has a coefficient of friction with respect to a golf ball different than a coefficient of friction between said ball and another of said faces.

30. The golf putter of claim 29 wherein said traction control insert is further defined as including a polymer matrix in which are imbedded grains of a material harder than said polymer.

31. The golf putter of claim 30 wherein said grains are further defined as being a metal.

32. The golf putter of claim 30 wherein said grains are further defined as being a refractory material.

33. The golf putter of claim 32 wherein said refractory material is further defined as being aluminum oxide.

34. The golf putter of claim 32 wherein said refractory material is further defined as being a carbide.

35. The golf putter of claim 34 wherein said carbide is further defined as being silicon carbide.

36. The golf putter of claim 35 wherein said silicon carbide grains have an approximate size in the range of 60 grit to 120 grit.

37. The golf putter of claim 36 wherein said polymer is further defined as being polyurethane.

38. The golf putter of claim 37 wherein said insert is further defined as having about 3–5 parts by weight of silicon carbide dispersed in a polyurethane matrix having a pre-cured liquid polymer melt weight of about 20 parts.

39. In a golf club having a shaft and a head, the improvement comprising;

a. providing a plurality of generally vertically disposed ball striking faces on said head which protrude upwardly from edges of a base of said head, b. providing a hosel receiving bore in an upper surface of said head, said hosel receiving bore having inner wall faces parallel to respective ones of said edges of said base formed by said ball striking faces, c. providing a prismatic-shaped hosel protruding from a lower end portion of said shaft, said hosel having a cross-sectional shape similar to that of said bore and adapted to be insertably and irrotatably received within said bore, and d. providing means for releasably securing said hosel within said bore, whereby said fastening means is releasable to enable withdrawal of said hosel from said bore, rotation of said head about a vertical axis of said bore to thereby position a selected one of said plurality of faces in a front ball striking position relative to said shaft, said hosel reinserted into said bore and re-secured thereto.

40. The improvement of claim 39 wherein said base edges of said head defined as a polygon.

41. The improvement of claim 40 wherein said polygon is a regular polygon.

42. The improvement of claim 40 wherein said regular polygon is an equilateral triangle.

43. The improvement of claim 40 wherein said polygon is rectangle.

* * * * *